US006658808B1

(12) United States Patent
Doherty et al.

(10) Patent No.: US 6,658,808 B1
(45) Date of Patent: Dec. 9, 2003

(54) INTERLOCKING BUILDING MODULE SYSTEM

(75) Inventors: Thomas S. Doherty, Weston, MA (US); William A. Anderson, Chatham, MA (US)

(73) Assignee: SCAE Associates, Weston, MA (US)

( * ) Notice: Subject to any disclaimer, the term of this patent is extended or adjusted under 35 U.S.C. 154(b) by 0 days.

(21) Appl. No.: 09/632,842

(22) Filed: Aug. 4, 2000

Related U.S. Application Data

(60) Provisional application No. 60/148,001, filed on Aug. 9, 1999.

(51) Int. Cl.[7] ..... E04C 3/00

(52) U.S. Cl. ..... 52/580; 52/588.1; 52/589.1; 52/731.2; 52/579

(58) Field of Search ..... 52/578, 580, 588.1, 52/650.3, 731.3, 731.2, 732.1, 732.2, 589.1, 592.1, 220.2, 579; 256/65.01, 66, 24

(56) References Cited

U.S. PATENT DOCUMENTS

| | | | | | |
|---|---|---|---|---|---|
| 3,698,149 | A | | 10/1972 | Baker et al. | 52/731 |
| 3,728,837 | A | | 4/1973 | Kiefer, Jr. | 52/731 |
| 3,742,672 | A | | 7/1973 | Schaeufele | 52/594 |
| 3,815,311 | A | | 6/1974 | Nisula et al. | 52/579 |
| 4,007,919 | A | * | 2/1977 | Totten | 256/59 |
| 4,236,366 | A | * | 12/1980 | Rijnders | 52/580 |
| 4,601,148 | A | | 7/1986 | Risi et al. | 52/284 |
| 4,903,453 | A | | 2/1990 | Newsom | 52/648 |
| 5,201,159 | A | * | 4/1993 | Goranson et al. | 52/580 |
| 5,406,768 | A | * | 4/1995 | Giuseppe et al. | 52/730.4 |
| 5,595,033 | A | | 1/1997 | Frey | 52/306 |
| 5,608,999 | A | | 3/1997 | McNamara | 52/275 |
| 5,681,194 | A | * | 10/1997 | Baker | 442/394 |
| 5,687,530 | A | | 11/1997 | Van der Heijden | 52/592.6 |
| 5,706,620 | A | * | 1/1998 | De Zen | 52/220.2 |
| 5,711,126 | A | * | 1/1998 | Wells | 52/519 |
| 5,715,641 | A | | 2/1998 | Hall, Jr. | 52/578 |
| 5,836,128 | A | * | 11/1998 | Groh et al. | 52/580 |
| 5,864,998 | A | | 2/1999 | Loomer | 52/271 |
| 5,894,702 | A | | 4/1999 | Stenekes | 52/606 |
| 6,017,595 | A | * | 1/2000 | Brenot et al. | 428/2 |
| 6,038,828 | A | | 3/2000 | Backman | 52/588.1 |
| 6,061,987 | A | | 5/2000 | King | 52/579 |
| 6,311,955 | B1 | * | 11/2001 | McGarry et al. | 52/589.1 |

FOREIGN PATENT DOCUMENTS

| | | | | |
|---|---|---|---|---|
| GB | 2126106 | * | 3/1984 | 52/580 |

* cited by examiner

*Primary Examiner*—Winnie Yip
(74) *Attorney, Agent, or Firm*—Weingarten, Schurgin, Gagnebin & Lebovici LLP

(57) ABSTRACT

A structural building module is provided as a generally rectangular, hollow, extruded, interlocking tubular element formed of a plastic material. The module has two opposed first sides and two opposed second sides extending along a longitudinal axis. Two flanges project from one of the second sides of the element parallel to the first sides and extend along the longitudinal axis for the length of the element. Two recessed areas extend along the longitudinal axis for the length of the element from another of the second sides of the element and aligned with the two flanges. The flanges of one module interlock with the recessed areas of an adjacent module. Structures made with the modules may be assembled easily and quickly. Individual modules have a high stiffness to weight ratio, rendering the modules particularly appropriate for low cost residential housing, auxiliary buildings such as garden sheds or garages, or emergency huts or shelters.

10 Claims, 6 Drawing Sheets

INTERLOCKING BUILDING MODULE SYSTEM

CROSS REFERENCE TO RELATED APPLICATIONS

This application claims the benefit under 35 U.S.C. §119 (e) of U.S. Provisional Application No. 60/148,001, filed on Aug. 9, 1999, the disclosure of which is incorporated by reference herein.

STATEMENT REGARDING FEDERALLY SPONSORED RESEARCH OR DEVELOPMENT

N/A

BACKGROUND OF THE INVENTION

Modular construction techniques have been used for a variety of structures, such as buildings, retaining walls, and bridges. Modular elements range from blocks to panels to fairly complex subassemblies. Many modular designs incorporate interlocking elements. Each of the various modular designs, however, is typically suited for a particular application or a particular material.

SUMMARY OF THE INVENTION

The present invention relates to an interlocking structural building module that is particularly useful for building structures such as low cost residential housing, such as might be needed for refugees or migrant farm workers, or auxiliary buildings such as garden sheds or garages. Structures made with the modular block system may be assembled easily and quickly and, because individual modules have a high stiffness to weight ratio, the system is particularly appropriate for emergency huts or shelters.

More particularly, the structural building module is a generally rectangular, hollow, extruded, interlocking tubular element formed of a plastic material. The module has two opposed first sides and two opposed second sides extending along a longitudinal axis. Two flanges project from one of the second sides of the element parallel to the first sides and extend along the longitudinal axis for the length of the element. Two recessed areas extend along the longitudinal axis for the length of the element from another of the second sides of the element and aligned with the two flanges. The flanges of one module interlock with the recessed areas of an adjacent module.

DESCRIPTION OF THE DRAWINGS

The invention will be more fully understood from the following detailed description taken in conjunction with the accompanying drawings in which.

DETAILED DESCRIPTION OF THE INVENTION

Figure 1:
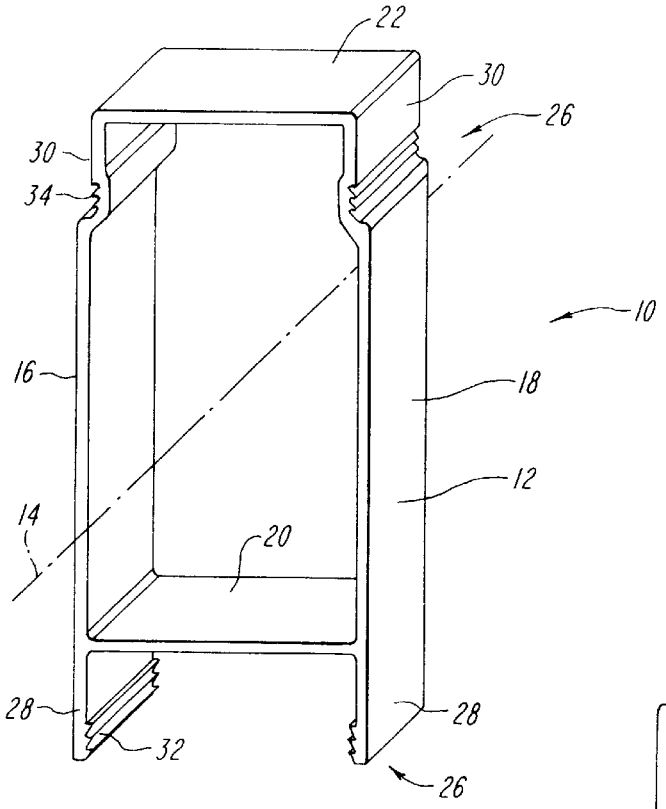
FIG. 1 an isometric view of a structural building module according to the present invention.
Figure 2:
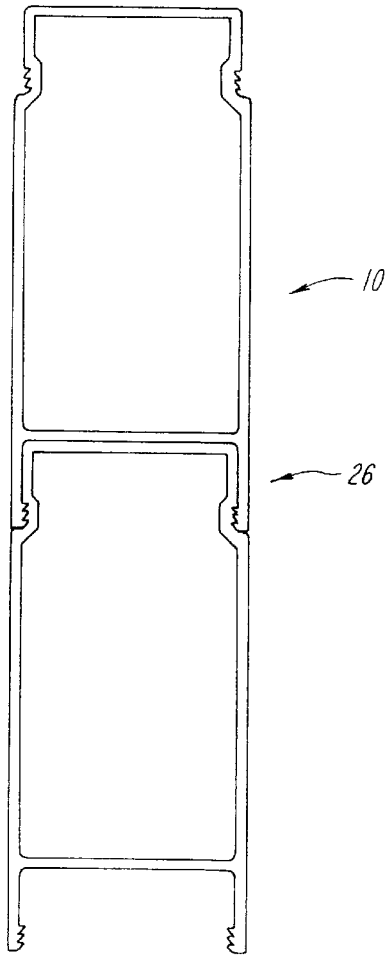
FIG. 2 is a side view of two interlocked modules.
Figure 3:
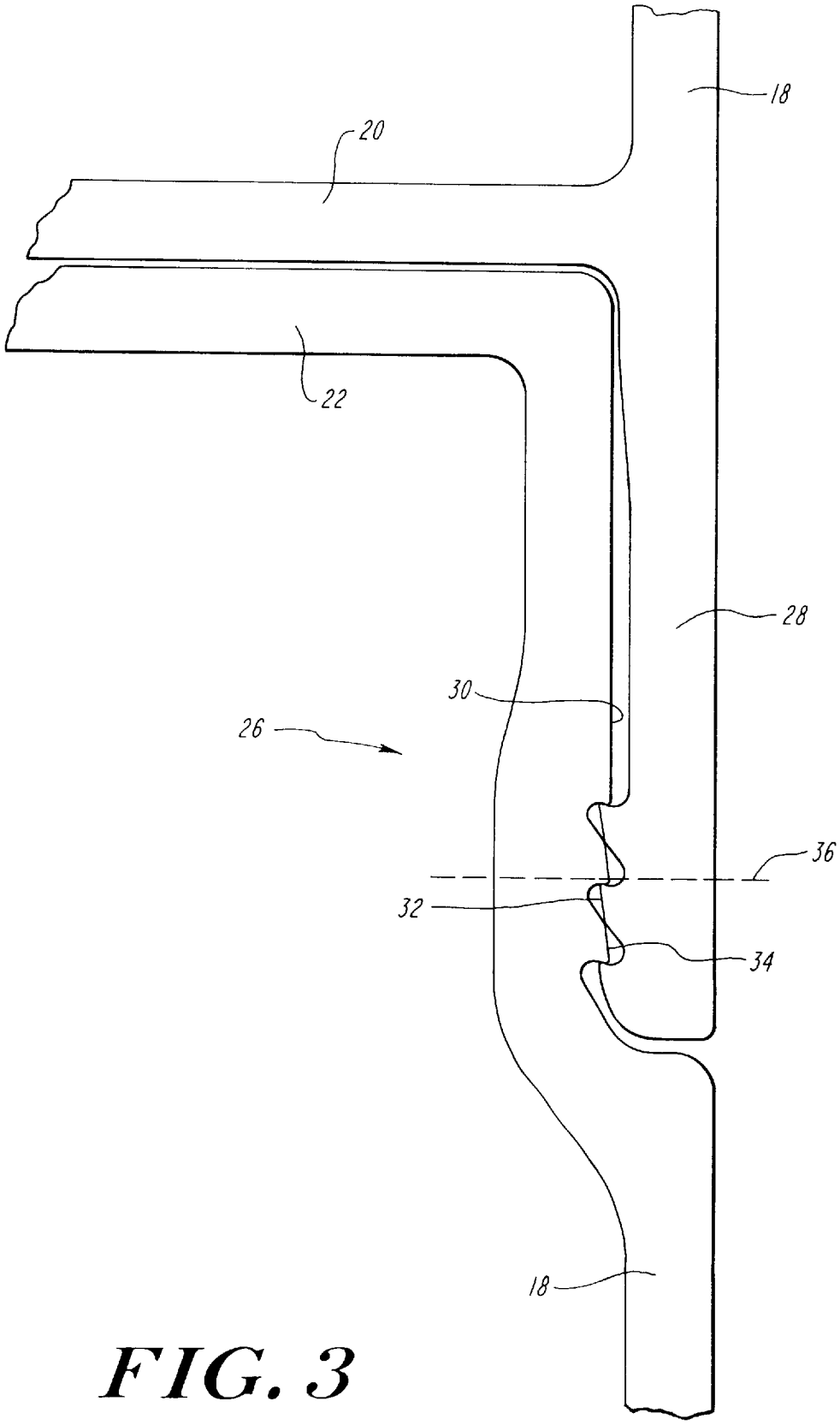
FIG. 3 is partial side view of the interlocking elements of module of FIG. 1.

One embodiment of an individual basic module 10 according to the present invention is illustrated in FIGS. 1–3. The basic module 10 is a hollow, extruded plastic, tubular element 12, generally rectangular in cross-section and extending generally along a longitudinal axis 14. The module has two opposed longer sides 16, 18 and two opposed shorter sides 20, 22. The module is open on both ends so that it is readily manufacturable by an extrusion process. The module may be as long as desired for an intended use. Eight-foot lengths are particularly useful for building structures, giving the module an overall rectangular tubular shape.

The module includes interlocking elements 26 to allow adjacent modules to be placed with shorter sides abutting. The interlocking elements include projections or flanges 28 running the length of the module. The flanges extend from one of the shorter sides 20 and are parallel to the longer sides 16, 18. The flanges 28 mate in corresponding recessed areas 30 running the length of the longer sides 16, 18 of the module adjacent the opposite shorter side 22. The flanges 28 and recessed areas 30 are configured with mating teeth 32, 34, shown further in FIG. 3, to prevent joined modules from becoming dissembled. The modules may be snapped together. The modules may be additionally fastened together if desired, such as by a screw or other fastening device through the mating flange and wall adjacent the recess, as indicated by the dotted line 36 in FIG. 3.

Figure 4:
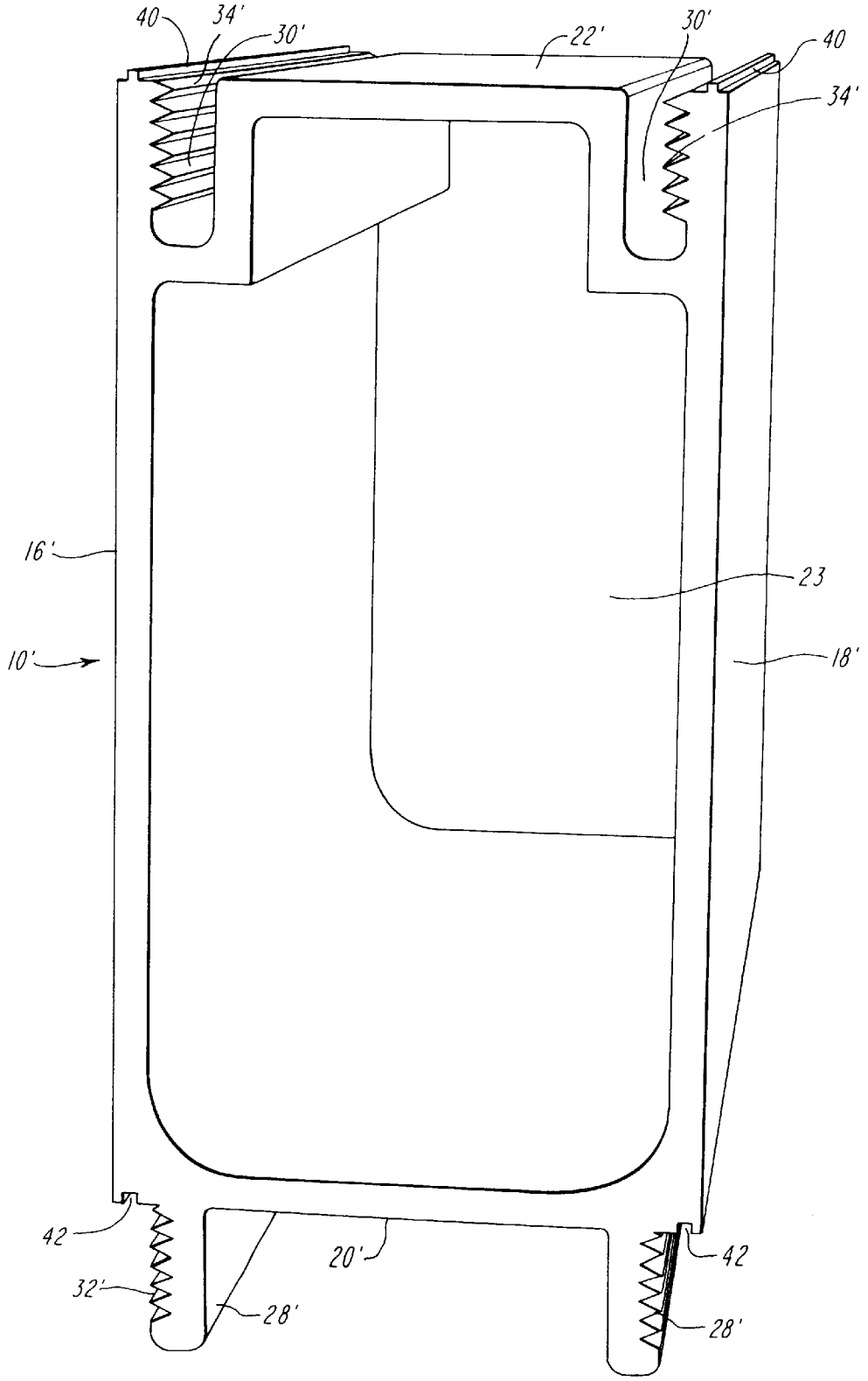
FIG. 4 is an isometric view of a further embodiment of a structural building module according to the present invention.

A further embodiment of an individual module 10' is illustrated in FIG. 4. As above, the module again is generally rectangular, having two longer sides 16', 18', two shorter sides 20', 22', open ends, and a hollow center 23. The module may be as long as is appropriate for the intended use, e.g., eight feet, so that its overall shape is that of a rectangular tube. One of the shorter sides 22' contains matching recessed areas 30' formed as slots parallel to both longer sides 16', 18', running the length of the module, while the opposite shorter side 20' contains matching long projections or flanges 28', also running the length of the module parallel to the longer sides. The flanges 28' are configured to mate with slots 30' on an adjacent module when the modules are assembled into a structure. The respective slots and flanges are configured with mating teeth 32', 34', to prevent joined modules from becoming dissembled. The modules may be assembled by inserting the flanges 28' into the corresponding slots 30' from one end and sliding one module longitudinally along the other module until the ends are aligned.

As shown in FIG. 4, secondary projections 40 may be provided adjacent the slots 30'. The secondary projections are designed to fit into corresponding secondary grooves 42 adjacent the flanges 28'. The secondary projections and grooves mate reciprocally in a safety lock when adjacent modules are assembled for prevention of a bend out and teeth disengagement failure mode. It will be appreciated that the secondary projections and secondary grooves may be provided on the module depicted in FIG. 1 as well.

Preferably, the modules are made of any extrudable plastic material, preferably recycled polymers such as polyethylene, polypropylene, ABS or polycarbonate, for stability and economy. Various percentages of a fill material, e.g., glass fill, can be blended into the bulk polymer before extrusion to raise the modulus of the resultant product. Fire retardant material, such as aluminum trihydrate, may also be added, as would be known in the art. The percentages of the additional components may be varied according to the properties desired in the completed module or to compensate for the variability of the recycled plastic. In a particularly preferred embodiment, the material comprises recycled PVC and approximately 10% by volume short fiberglass fill to achieve a modulus of elasticity of 350 kpsi.

Figure 5:
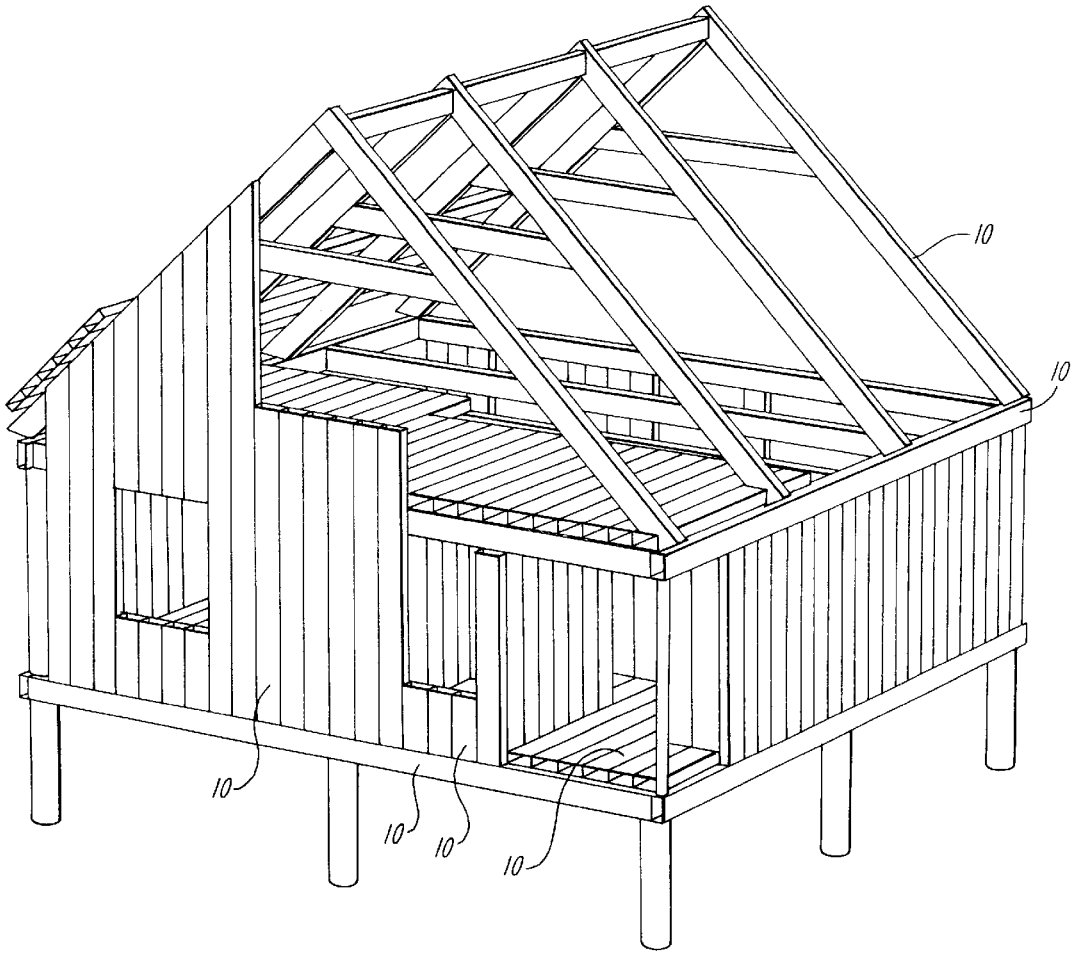
FIG. 5 is a schematic view of a structure constructed from building modules according to the present invention.
Figure 6:
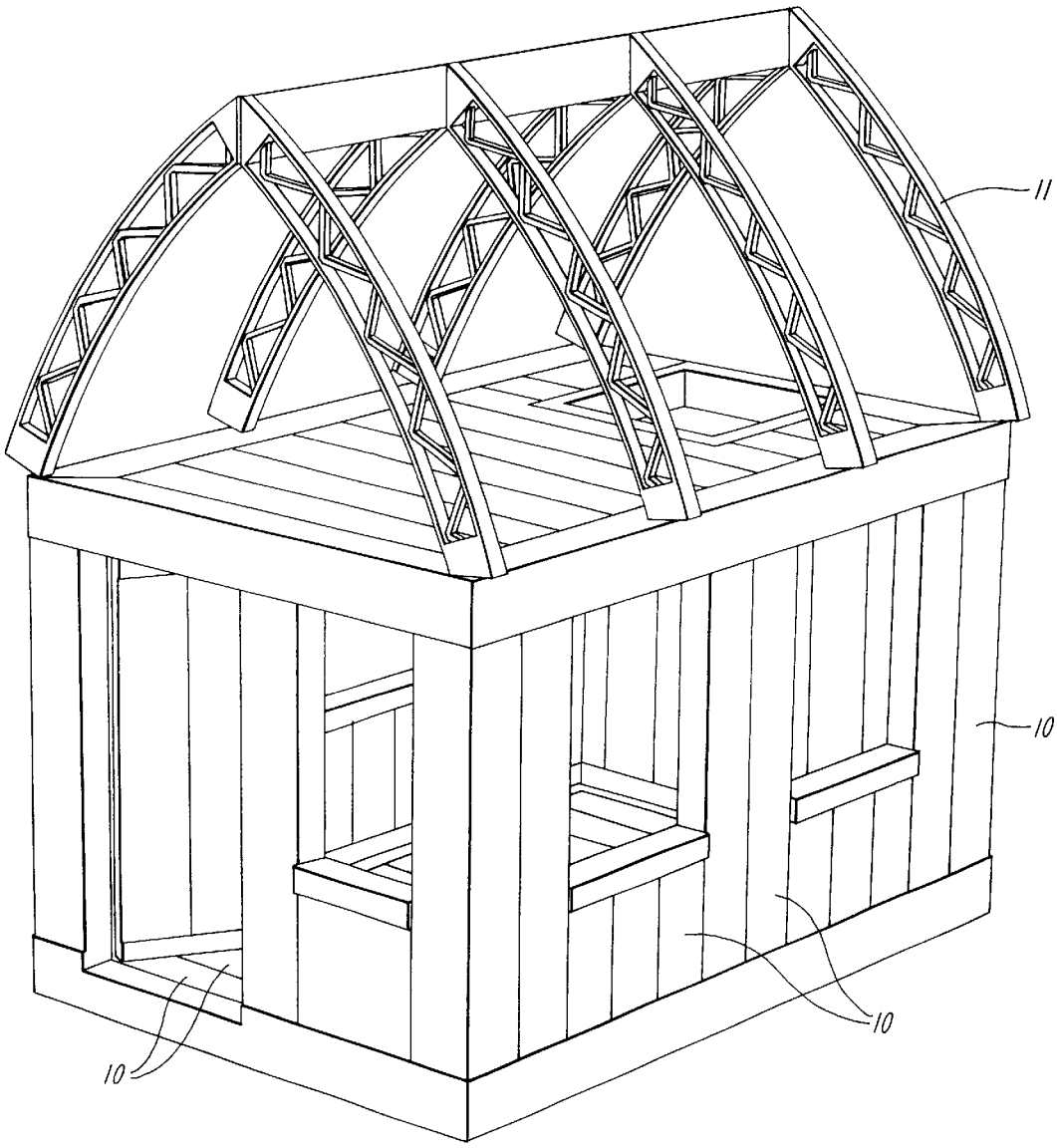
FIG. 6 is a schematic view of a further structure constructed from building modules according to the present invention.

The unique shape of the module permits the same module design to be used for the construction of flooring, walls and roofing of a structure. Examples of structures formed from the present module are illustrated in FIGS. 5 and 6. The modules may be combined with other structural members, such as the truss-like curved roof rafters 11 illustrated in FIG. 6.

In one suitable embodiment, the shorter sides 20, 22 of the basic module 10 are approximately six inches in length, and the longer sides 16, 18 have a pitch between teeth on the flanges 28 of approximately twelve inches, although any suitable dimensions may be used. An individual module 10 is designed with an aspect ratio sufficient to provide a suitable stiffness for the desired use, such as for walls, flooring, roofing and/or structural members. The aspect ratio is defined as the ratio of the dimension of a longer side 16, 18 transverse to the longitudinal axis 14 to the dimension of a shorter side 20, 22 transverse to the longitudinal axis 14. An aspect ratio of 5:1 is probably the maximum suitable. An aspect ratio of approximately 2:1 is preferred for a useful stiffness for a variety of applications. The ratio of the transverse dimension of a shorter side to web thickness should be approximately 16:1. Vertical structural stiffness may be maintained by vertical orientation of the modules in an assembled unit, as shown in FIGS. 5 and 6, and panel deflections may be managed by appropriately spaced structural support members. A variety of porosity levels or web thicknesses can be provided in various locations, to better optimize stress handling for a particular application.

Figure 7:
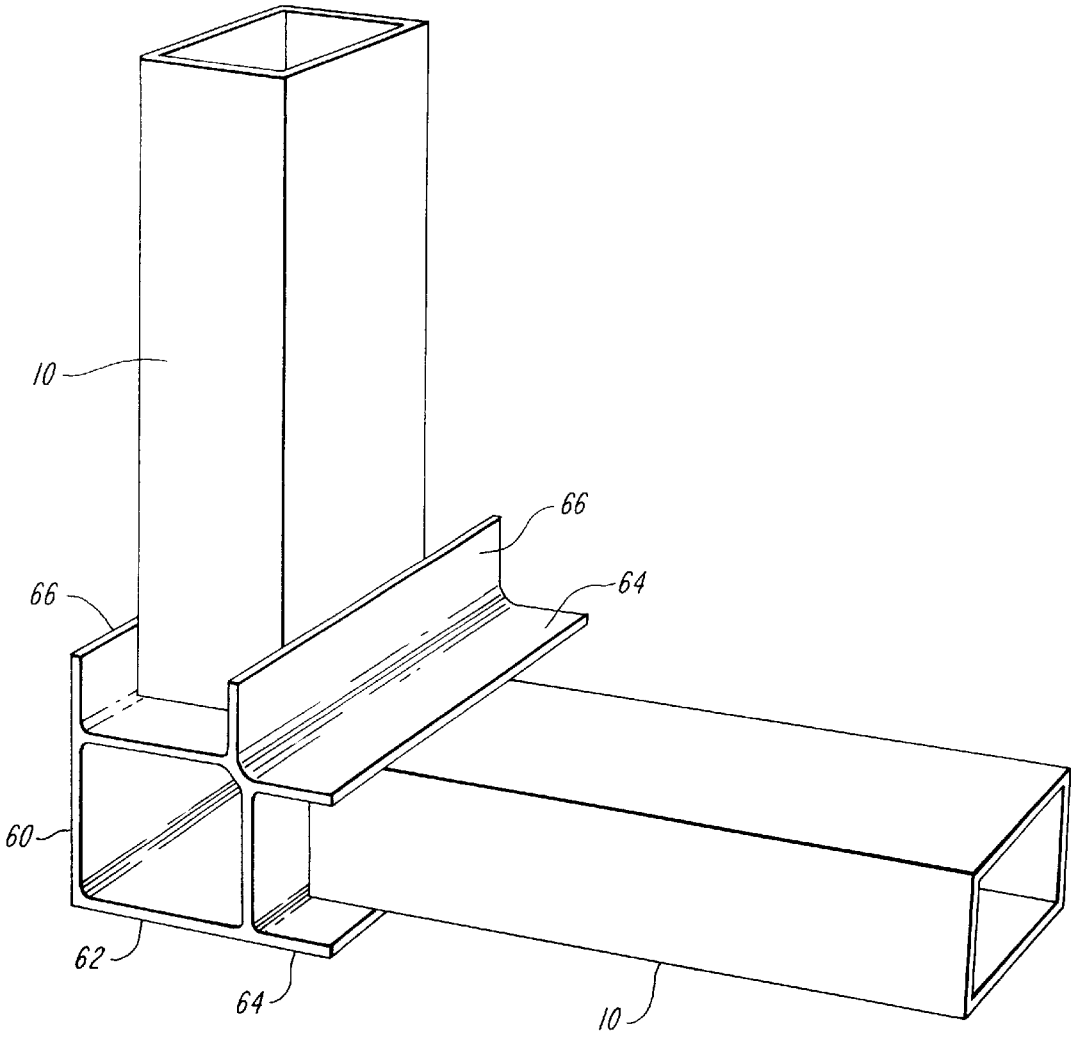
FIG. 7 is an isometric view of a connecting element for use with building modules according to the present invention.

Suitable connector or branching modules are also provided. An L-shaped right angle connecting module 60 is illustrated schematically in FIG. 7. The right angle connecting module is a generally rectangular or square elongated tube 62 with pairs of flanges 64, 66 projecting from two sides. The ends of the basic module fit within the flanges of the connecting module and are fastened thereto in any suitable manner, such as with screws, adhesive, an interlocking configuration, or by any other manner known in the art. For clarity only, one basic module is shown within each pair of flanges, and the module is shown only schematically, without the interlocking elements 26. Additional connecting module shapes to facilitate inner wall branching, such as a T-shaped connecting module for joining three basic modules, may be provided. Plastic or wooden plugs may be provided to cap open ends of individual basic modules.

Numerous modifications are contemplated for particular uses. For example, modules designed as support members can be extruded with a layer of a stiffening material, e.g., Kevlar®, overlaid in the hot plastic. A coating material may be applied to the exterior of a unit of assembled modules, e.g., for sealing purposes or for decoration (simulated woodgrain). The modules may be extruded in a curved configuration, which may be useful, for example, for roof rafters. For use in walls and roofs, insulation can be blown into the hollow pockets in the interior of assembled modules. Conduits for electrical connections or for water can also be strung in the interior of the modules, and cutouts can be made for electrical outlets or for doors or windows. To prevent water infiltration at the interlocked seams between modules for exterior surfaces of walls and/or roofing applications, the multi-tooth joint design provides a labyrinth fluid seal. Fasteners and/or flexible sealants may be used alternatively or in addition to the multi-tooth joint design, depending on the application or type of joint.

The invention is not to be limited by what has been particularly shown and described, except as indicated by the appended claims.

What is claimed is:

1. A structural building module comprising:

a generally rectangular, hollow, extruded, tubular element formed of a plastic material and having two opposed first sides and two opposed second sides extending along a longitudinal axis, the element further having open ends;

two flanges projecting from one of the second sides of the element parallel to and in alignment with the first sides to form symmetrical extensions of the first sides extending along the longitudinal axis for the length of the element;

two recessed areas extending along the longitudinal axis for the length of the element from another of the second sides of the element and aligned with the two flanges, the recessed areas comprising inwardly formed symmetrical portions of the first sides adjacent the other of the second sides; and the flanges further include teeth near a tip region thereof, and the recessed areas further include teeth therein located and configured to interlock with the teeth of the flanges of an adjacent module to hold adjacent modules in abutting contact with the second sides of adjacent modules being abutted in contact with each other.

2. The structural building module of claim 1, wherein the first sides have a first dimension transverse to the longitudinal axis and the second sides have a second dimension transverse to the longitudinal axis, the element having an aspect ratio of the first dimension to the second dimension of no more than 5:1.

3. The structural building module of claim 2, wherein the aspect ratio of the first dimension to the second dimension is approximately 2:1.

4. The structural building module of claim 1, wherein the first sides have a first dimension transverse to the longitudinal axis and the second sides have a second dimension transverse to the longitudinal axis, the first dimension of the first sides being greater than the second dimension of the second sides.

5. The structural building module of claim 1, wherein the plastic material comprises a polyethylene, polypropylene, ABS, polycarbonate, or polyvinylchloride.

6. The structural building module of claim 1, wherein the plastic material comprises a recycled polymer.

7. The structural building module of claim 1, further comprising a filler in the plastic material to increase strength.

8. The structural building module of claim 7, wherein the filler comprises fiberglass.

9. The structural building module of claim 1, further comprising a fire retardant material in the plastic material.

10. The structural building module of claim 9, wherein the fire retardant material comprises aluminum trihydrate.

* * * * *